US009694585B2

(12) United States Patent
Shiba et al.

(10) Patent No.: US 9,694,585 B2
(45) Date of Patent: Jul. 4, 2017

(54) LIQUID FILLING METHOD OF LIQUID CONTAINER

(71) Applicant: CANON KABUSHIKI KAISHA, Tokyo (JP)

(72) Inventors: Akira Shiba, Machida (JP); Naozumi Nabeshima, Tokyo (JP); Koichi Kubo, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 63 days.

(21) Appl. No.: 14/724,343

(22) Filed: May 28, 2015

(65) Prior Publication Data

US 2015/0352851 A1 Dec. 10, 2015

(30) Foreign Application Priority Data

Jun. 10, 2014 (JP) ..... 2014-119645

(51) Int. Cl.
*B41J 2/175* (2006.01)

(52) U.S. Cl.
CPC ..... *B41J 2/17506* (2013.01); *B41J 2/175* (2013.01); *B41J 2/17513* (2013.01)

(58) Field of Classification Search
CPC .... B41J 2/175; B41J 2/17506; B41J 2/17513; B41J 2/17503; B41J 2002/17516
USPC ..... 141/4–5, 7–8, 65, 102; 347/84–86, 92
See application file for complete search history.

(56) References Cited

U.S. PATENT DOCUMENTS 6,332,481 B1 * 12/2001 Shinada ..... B41J 2/17503 141/18
7,950,790 B2 5/2011 Kubo et al. ..... 347/86
8,047,641 B2 11/2011 Nanjo et al. ..... 347/86
8,197,041 B2 * 6/2012 Morino ..... B41J 2/17509 347/19
8,205,974 B2 6/2012 Ogura et al. ..... 347/86
8,240,822 B2 * 8/2012 Yokouchi ..... B41J 2/175 347/85
8,469,498 B2 6/2013 Ohashi et al. ..... 347/86
8,770,730 B2 7/2014 Nanjo et al. ..... 347/86
8,770,731 B2 7/2014 Miyashita et al. ..... 347/86
9,016,842 B2 4/2015 Miyashita et al. ... B41J 2/17596

(Continued)

FOREIGN PATENT DOCUMENTS

JP 2006-175855 7/2006
JP 2007-062337 3/2007

OTHER PUBLICATIONS

U.S. Appl. No. 14/744,926, filed Jun. 19, 2015; Inventors: Hiroshi Koshikawa, Yasuo Kotaki, Kenta Udagawa, Naozumi Nabeshima, Soii Kondo, Masafumi Seki.

(Continued)

*Primary Examiner* — Nicolas A Arnett

(74) *Attorney, Agent, or Firm* — Fitzpatrick, Cella, Harper & Scinto

(57) ABSTRACT

There is provided a method of filling a liquid container with liquid such that an amount of remaining air is suppressed to be as small as possible. For this purpose, while performing, on a liquid containing chamber, a primary pressure reduction, a primary injection, a secondary pressure reduction, and a secondary injection in turn, degrees of the primary pressure reduction and secondary pressure reduction are each appropriately adjusted to fill the liquid with a target amount of air remaining.

8 Claims, 7 Drawing Sheets

(56) References Cited

U.S. PATENT DOCUMENTS

2001/0052370 A1* 12/2001 Shinada ..... B41J 2/17503 141/2
2002/0012033 A1* 1/2002 Iwanaga ..... B41J 2/17503 347/86
2003/0122909 A1* 7/2003 Ogura ..... B41J 2/17506 347/86
2005/0062809 A1* 3/2005 Yoshino ..... B41J 2/17556 347/85
2005/0248634 A1* 11/2005 Aruga ..... B41J 2/175 347/85
2005/0285913 A1* 12/2005 Yoshino ..... B41J 2/16532 347/85
2006/0061639 A1* 3/2006 Yoshino ..... B41J 2/17596 347/85
2006/0132555 A1 6/2006 Uehara et al. ..... 347/85
2008/0062231 A1* 3/2008 Kubo ..... B41J 2/17523 347/86
2010/0020137 A1* 1/2010 Yokouchi ..... B41J 2/175 347/85
2010/0026742 A1* 2/2010 Morino ..... B41J 2/17509 347/7
2010/0238240 A1* 9/2010 Yokouchi ..... B41J 2/175 347/85
2012/0139979 A1* 6/2012 Tokuno ..... B41J 2/175 347/6

OTHER PUBLICATIONS

U.S. Appl. No. 14/744,939, filed Jun. 19, 2015; Group Art Unit: 2853; Inventors: Soji Kondo, Yasuo Kotaki, Kenta Udagawa, Naozumi Nabeshima, Tatsuo Nanjo, Kazuya Yoshii.
U.S. Appl. No. 14/744,973, filed Jun. 19, 2015; Group Art Unit: 2853; Inventors: Masafumi Seki, Naozumi Nabeshima, Koichi Kubo, Kazuya Yoshii.
U.S. Appl. No. 14/829,333, filed Aug. 18, 2015; Inventors: Kei Kosaka, Atsushi Takahashi, Tomoyuki Tenkawa, Akiyoshi Sahara, Toshiyuki Kuroda, Kei Takarabe.
U.S. Appl. No. 14/829,336, filed Aug. 18, 2015; Inventors: Atsushi Takahashi, Kei Kosaka, Tomoyuki Tenkawa, Naozumi Nabeshima.

* cited by examiner

LIQUID FILLING METHOD OF LIQUID CONTAINER

BACKGROUND OF THE INVENTION

Field of the Invention

The present invention relates to a liquid filling method of a liquid container.

Description of the Related Art

A liquid container such as an ink tank that contains ink and supplies it to a printing head is required to be configured to be capable of smoothly supplying the contained ink (liquid) until the ink is used up without leakage thereof.

Japanese Patent Laid-Open No. 2007-062337, for example, discloses a configuration in which use of a spring and a flexible sheet generates an appropriate amount of negative pressure within a liquid containing chamber. Such a configuration as in Japanese Patent Laid-Open No. 2007-062337 enables supply of liquid at a stable flow velocity and flow rate while making it possible to contain more ink, compared to conventional configurations having an absorbent such as a sponge within the liquid containing chamber. However, there is a case where when air remains within the liquid containing chamber after the liquid containing chamber is filled with the liquid, the volume of the air fluctuates according to a change in temperature or pressure at the time of distribution, causing a concern for leakage of the liquid. Therefore, it is desirable that, at the time of shipping from a factory, the amount of the air within the liquid containing chamber be suppressed to be small to the extent that leakage does not occur even with a change in environments.

Japanese Patent Laid-Open No. 2006-175855 discloses a method in which injecting liquid into a liquid containing chamber is followed by actively collecting remaining air at a specified portion to suck the air in the volume from the liquid containing chamber. According to the method of Japanese Patent Laid-Open No. 2006-175855, shipping is available in a state in which the air within the liquid containing chamber is reduced as much as possible, whereby arrival with no leakage of the liquid can be expected even with a change in temperature or pressure at the time of distribution.

SUMMARY OF THE INVENTION

An object of the present invention is to provide a method of filling a liquid containing chamber with liquid such that an amount of remaining air is suppressed to be as small as possible.

In an aspect of the present invention, there is provided a liquid filling method of a liquid container that is equipped with: a case member having a supply port for leading out liquid; a flexible sheet which is adhesively fixed to the case member to form, together with the case member, a liquid containing chamber capable of containing the liquid; and a spring member which biases, via a plate member, the flexible sheet in a direction in which a capacity of the liquid containing chamber is enlarged, the liquid filling method comprising: a primarily pressure reducing step of reducing pressure inside the liquid containing chamber to make the capacity of the liquid containing chamber to be a minimum capacity; a primarily injecting step of injecting the liquid in an amount smaller than the minimum capacity into the liquid containing chamber with the pressure reduced in the primarily pressure reducing step; a secondarily pressure reducing step of reducing the pressure inside the liquid containing chamber with the liquid injected in the primarily injecting step to make the capacity of the liquid containing chamber to be the minimum capacity, followed by sucking air in the liquid containing chamber with a predetermined amount of air remaining; and a secondarily injecting step of injecting the liquid into the liquid containing chamber after the secondarily pressure reducing step.

Further features of the present invention will become apparent from the following description of exemplary embodiments (with reference to the attached drawings).

DESCRIPTION OF THE EMBODIMENTS

In a case where a flexible sheet is used, as in Japanese Patent Laid-Open No. 2007-062337, air is trapped in various portions depending on the shape of the flexible sheet. In that case, collection of the air to be sucked at a specified portion is difficult, causing a risk of actually sucking the liquid instead of the air even if a sucking operation of an amount corresponding to the air is performed. In other words, the configuration in which a flexible sheet is used still has had difficulty in sufficiently reducing the amount of the remaining air after the liquid is filled. The present invention is achieved to solve the above problem.

First Embodiment

Figure 1:
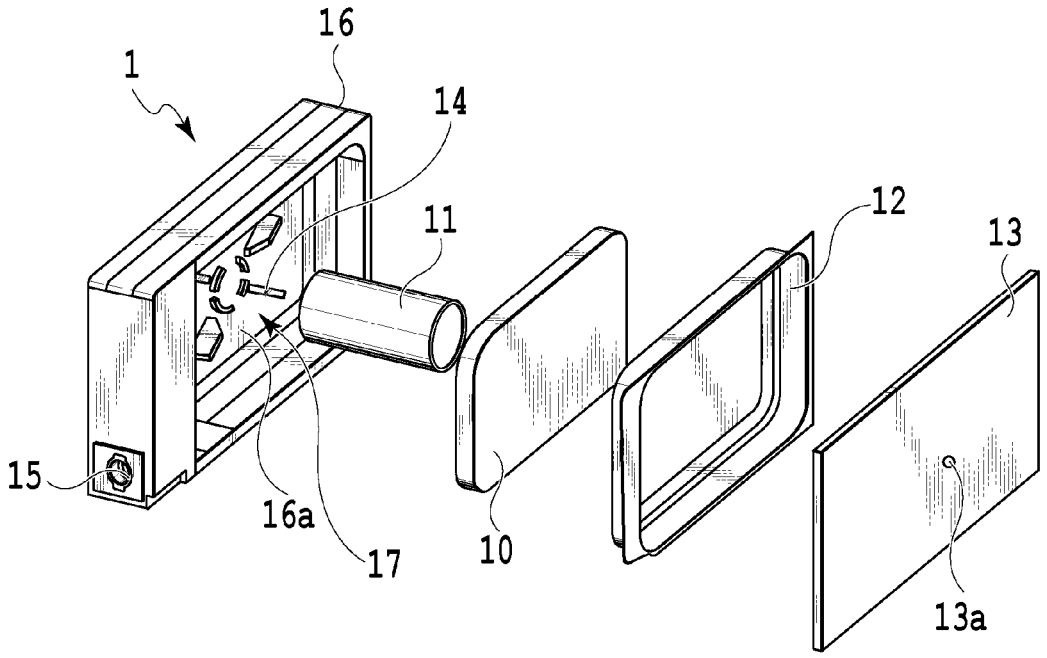
FIG. 1 is a structural exploded view of a liquid container usable in the present invention.

FIG. 1 is a structural exploded view of a liquid container usable in the present invention. A liquid container 1 according to the present embodiment is usable as an ink tank capable of containing ink to be supplied to an ink jet printing head. In the liquid container 1, a side portion of a case member 16 which contains liquid is provided with a supply port 15 for leading out the liquid contained to the outside (the printing head). A spring member 11 made of a compression coil, a pressure plate 10 made of a plate member, and a flexible sheet 12 which is adhesively fixed to an inner wall 16*a* and has a folding-back portion, are pressed toward the inner wall 16*a* of the case member 16 in this order, and further a cover member 13 is placed as a cover, whereby the liquid container 1 is completed. The inside of the liquid container 1 is divided into two spaces by the flexible sheet 12 and a space defined between the inner wall 16*a* and the flexible sheet functions as a liquid containing chamber 17 which actually contains the liquid. The supply port 15 is disposed on the side of the liquid containing chamber 17, the supply port 15 normally being sealed with a rubber member.

Piercing the supply port 15 with an injection needle 5 brings the liquid container 1 into communication with the outside.

The spring member 11 biases the pressure plate 10 to enlarge the capacity of the liquid containing chamber 17, whereby a constant negative pressure is maintained within the liquid containing chamber 17. Meanwhile, the cover member 13 has an atmosphere communication port 13*a* formed thereon, whereby an atmospheric pressure is maintained in a space defined between the flexible sheet 12 and the cover member 13.

When the liquid containing chamber 17 is sufficiently filled with liquid (for example, ink), a negative pressure due to the biasing force of the spring member is generated within the liquid containing chamber 17. As the liquid is consumed, the negative pressure within the liquid containing chamber 17 increases and the pressure plate 10 gradually moves leftward against the biasing force of the spring member 11. However, the inner wall 16*a* is provided with supporting posts 14 for controlling the movement of the pressure plate 10, and the pressure plate stops moving at the point when the pressure plate 10 abuts on the supporting posts 14. The capacity in this state is the minimum capacity of the liquid containing chamber 17 at the time of consumption of the liquid.

Figure 2:
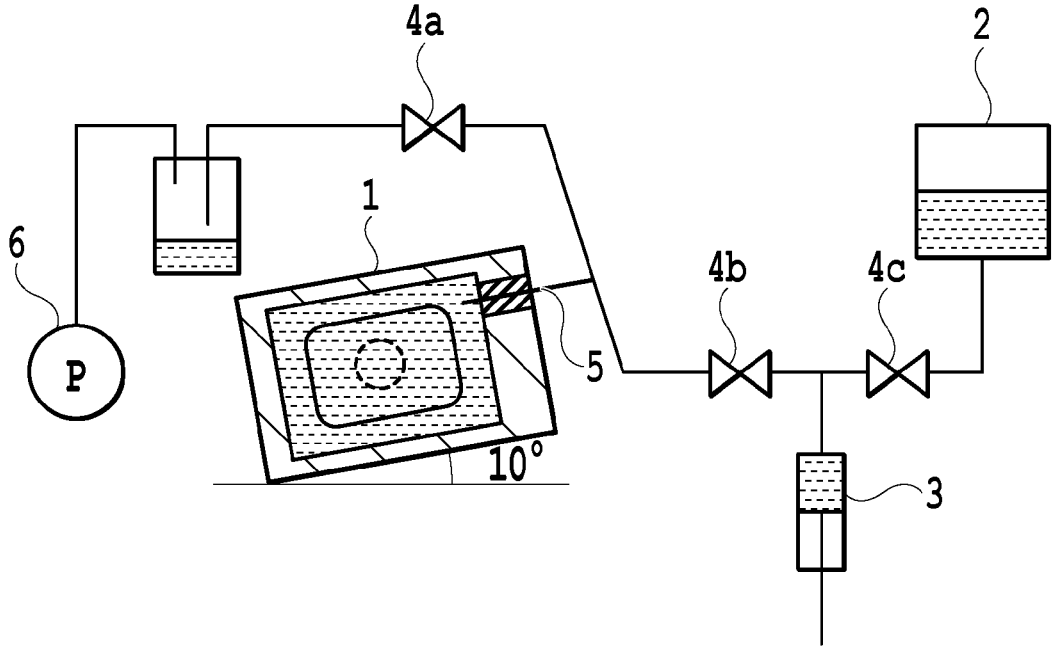
FIG. 2 is a constitutional view showing filling of the liquid container with liquid.

FIG. 2 is a constitutional view showing filling of the liquid container 1 with liquid. The liquid container 1 with the injection needle 5 pierced thereinto is fixed in a posture tilted by about 10° as shown in FIG. 2. In this state, controlling opening and closing of valves 4*a* to 4*c* while driving a pump 6 enables injection of the liquid reserved in a liquid reservoir 2 into the liquid container 1 or suction of the air or liquid in the liquid container 1.

In the present embodiment, the operation of filling the liquid container 1 with liquid is carried out in four stages as follows: a primarily pressure reducing step→a primarily injecting step→a secondarily pressure reducing step→a secondarily injecting step.

Figure 3A:
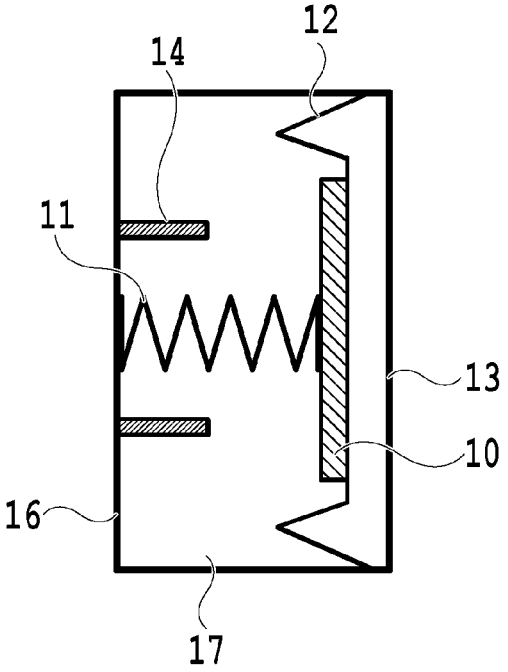
FIGS. 3A and 3B are cross-sectional views showing a state of the liquid container before and after a primarily pressure reducing step, respectively.
Figure 3B:
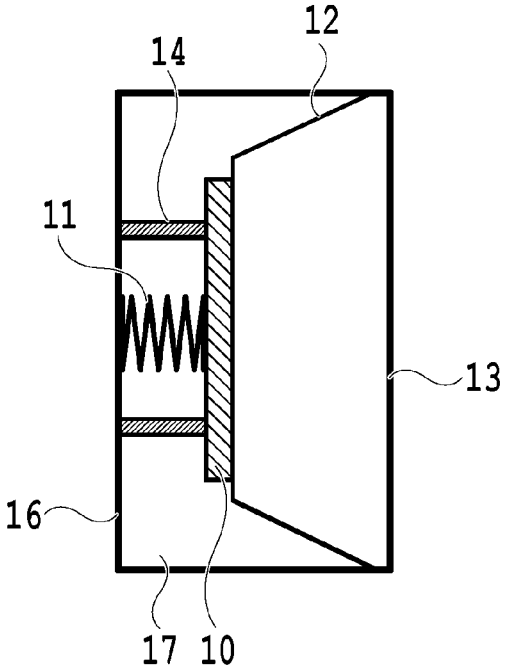

FIGS. 3A and 3B are cross-sectional views showing a state of the liquid container 1 before initiation and after completion of the primarily pressure reducing step, respectively. Before performing the primarily pressure reducing step, the inside of the liquid containing chamber 17 is empty, substantially in an atmospheric pressure, and in this state, the pressure plate 10 is pressed toward the cover member 13 by the spring member 11 as shown in FIG. 3A, maximizing the capacity of the liquid containing chamber 17.

Referring back to FIG. 2, in the above-described state, when only the valve 4*a* is opened while the pump 6 is being driven, the pressure inside the liquid containing chamber 17 is gradually reduced and the pressure plate 10, together with the flexible sheet 12, moves leftward and finally abuts on the supporting posts 14 to stop moving (FIG. 3B). When the pump 6 is further kept driven, the pressure inside the liquid containing chamber 17 is further reduced. Furthermore, in the present embodiment, when pressure reduction of about −30 to −40 kPa is achieved, the valve 4*a* is closed, and then the primarily pressure reducing step is completed. Incidentally, by leaving the liquid containing chamber 17 in this state for a certain period of time and observing a change in pressure inside the liquid containing chamber 17, the liquid containing chamber 17 may also be tested for the sealing property.

In the subsequent primarily injecting step, the liquid is flowed into the liquid containing chamber 17. The liquid flows into the chamber in an amount predetermined by a dispenser 3 shown in FIG. 2. The amount of the liquid flowing into the chamber is changed depending on a pressure reducing value at the time of the secondary pressure reduction and the minimum capacity varying according to the pressure reducing value. At the time of injection, only the valve 4*b* is opened, and when the liquid is made to flow into the dispenser 3 from the liquid reservoir portion 2, the valve 4*c* is opened. In the present embodiment, the liquid is made to flow into the chamber in an amount smaller than the minimum capacity shown in FIG. 3B.

Figure 4A:
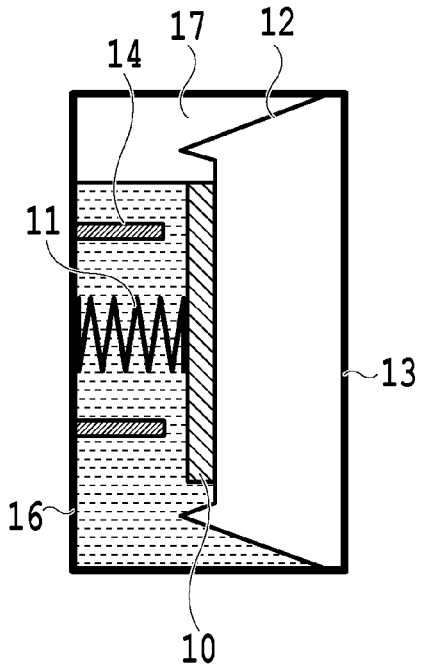
FIGS. 4A and 4B are views showing a state of the liquid container at the time of completion of a primarily injecting step.
Figure 4B:
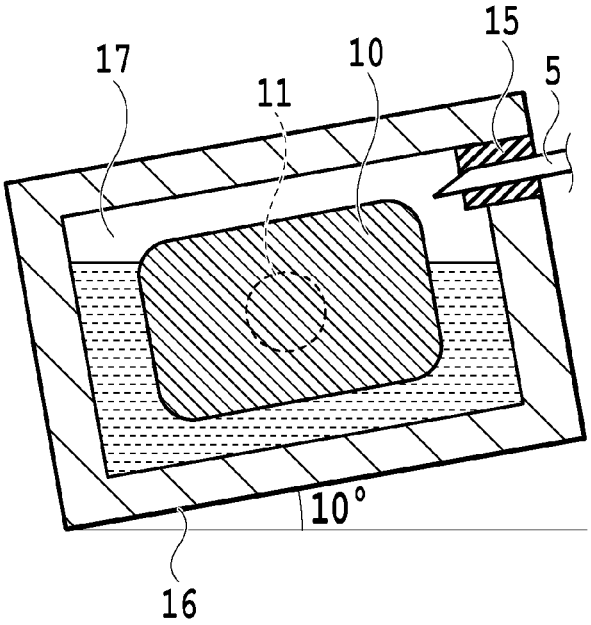

FIGS. 4A and 4B are views showing a state of the liquid container 1 at the time of completion of the primarily injecting step. The injection of the liquid relieves the degree of pressure reduction in the liquid containing chamber 17 and causes the pressure plate 10 to leave the supporting posts 14 due to the biasing force of the spring member 11 again, as shown in FIG. 4A. Since the amount of the liquid made to flow into the chamber is smaller than the minimum capacity, the air and the liquid are both present within the liquid containing chamber 17. On that basis, the liquid container 1 is tilted by about 10°, whereby the air goes upward relative to the gravity direction to gather in the vicinity of the injection needle 5 of the supply port 15, as shown in FIG. 4B.

In the subsequent secondarily pressure reducing step, the valve 4*b* and the valve 4*c* are closed and the valve 4*a* is opened, once again, thereby sucking the air located in the vicinity of the injection needle 5 through the injection needle 5.

Figure 5A:
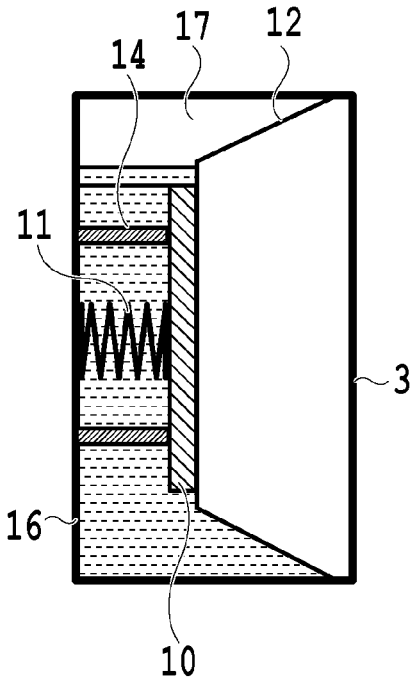
FIGS. 5A and 5B are views showing a state of the liquid container at the time of completion of a secondarily pressure reducing step.
Figure 5B:
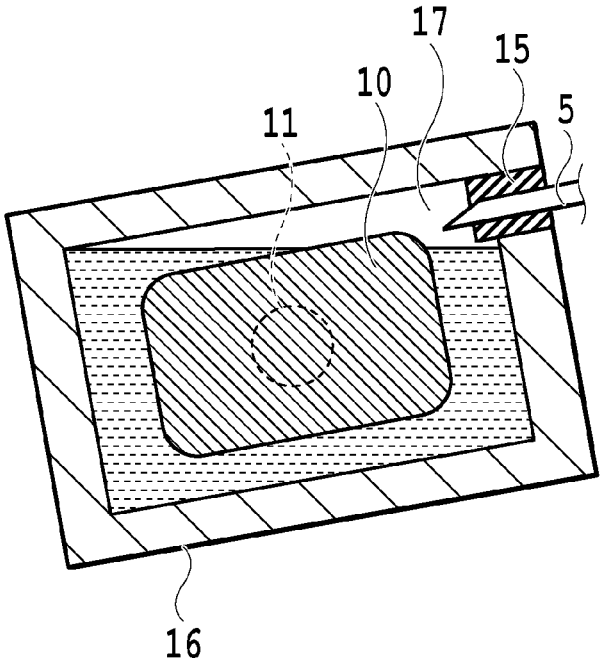

FIGS. 5A and 5B are cross-sectional views showing a state of the liquid container 1 after completion of the secondarily pressure reducing step. By sucking the air within the liquid containing chamber 17, the pressure plate 10, together with the flexible sheet 12, once again moves leftward to abut on the supporting posts 14 (FIG. 5A). Keeping the pump being driven after the abutment further reduces the pressure within the liquid containing chamber 17. This pressure reducing operation also causes the liquid level (the gas-liquid interface) to rise, but the amount of the liquid made to flow into the chamber in the primarily injecting step is smaller than the minimum capacity, and thus the liquid level is less likely to reach the injection needle 5. There is a case where, as the degree of pressure reduction is gradually increased, bubbles generated in the primarily injecting step gather on the liquid level to discharge a few droplets through the injection needle 5, but basically only the air is discharged through the injection needle 5. Further, in the present embodiment, when pressure reduction of about −90 to −95 kPa is achieved, the valve 4*a* is closed, and then the secondarily pressure reducing step is completed. In the present embodiment, in this stage, 1 to 3 cc of the air whose pressure is reduced at a predetermined pressure reducing value remains within the liquid containing chamber 17.

In the subsequent secondarily injecting step, only the valve 4*b* is opened and, when the liquid is made to flow into the dispenser 3 from the liquid reservoir portion 2, the valve 4*c* is opened, thereby making the liquid reserved in the liquid reservoir 2 to flow into the liquid containing chamber 17. In the secondarily injecting step, an amount of the liquid obtained by subtracting, from the amount of the liquid finally required, the amount of the liquid already injected in the primarily injecting step is made to flow into the chamber by the dispenser 3. Specifically, the liquid is made to flow into the chamber in an amount corresponding to the amount obtained by subtracting, from the capacity unoccupied by the liquid within the liquid containing chamber 17, 1 to 3 cc of the air to be left. Here, the amount of the liquid obtained by subtracting indicates a target amount of the liquid for filling the liquid containing chamber.

Figure 6:
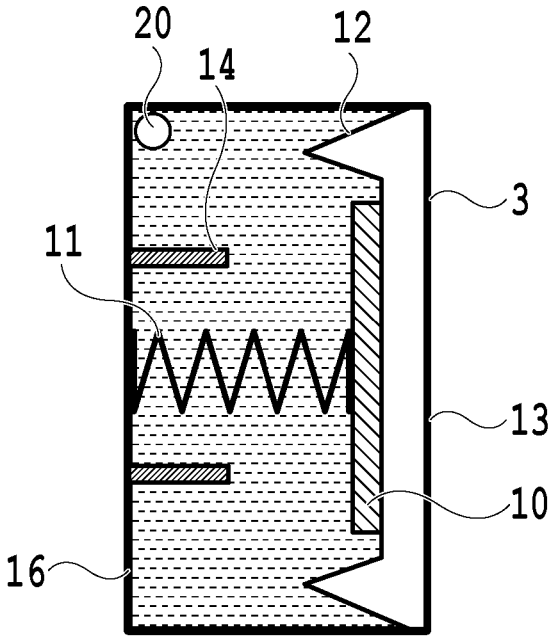
FIG. 6 is a view showing a state of the liquid container at the time of completion of a secondarily injecting step.

FIG. 6 is a view showing a state of the liquid container 1 at the time of completion of the secondarily injecting step. Air 20 which is not sucked in the secondarily pressure reducing step remains within the liquid containing chamber 17, but the inside of the liquid containing chamber 17 is left open to the atmosphere, and thus 1 to 3 cc of the air at the degree of pressure reduction of about −90 to −95 kPa is contracted to about 1/10, or 0.3 cc or under. As a result, filling of the liquid container 1 with the liquid, with about 0.3 cc of the air included therein, is completed.

In a series of the steps described above, the volume, 0.3 cc of the air finally remaining, is determined by the volume of the air to be left within the liquid containing chamber 17 in the secondarily pressure reducing step, the volume of the air to be left being determined by the degree of pressure reduction (−90 to −95 kPa) realized in the secondarily pressure reducing step. Further, in order to suck only the air as much as possible from the injection needle 5 so as not to significantly increase the degree of pressure reduction, it is required that the ink be injected to a certain extent in the primarily injecting step so as to sufficiently reduce the region occupied by the air. Furthermore, the amount of the liquid to be injected in the primarily injecting step depends on the pressure reducing value at the time of the secondary pressure reduction and the minimum capacity varying according to the pressure reducing value. That is, the amount of the air (0.3 cc) finally remaining is a value determined both by the degree of pressure reduction (−90 to −95 kPa) set in the secondarily pressure reducing step and by the amount of the liquid set in the primarily injecting step. In other words, relative to the minimum capacity of the liquid containing chamber 17, the minimum capacity varying according to the secondary pressure reducing value, the amount of the liquid in the primarily injecting step and the degree of the pressure reduction in the secondarily pressure reducing step are each appropriately adjusted, thereby making it possible to control the amount of the air finally remaining to a preferable value.

As stated above, according to the present embodiment, while the primary pressure reduction, the primary injection, the secondary pressure reduction, and the secondary injection are carried out in turn, the degrees of the primary pressure reduction and secondary pressure reduction are each appropriately adjusted, thereby making it possible to fill the liquid container with liquid with the air remaining in a predetermined amount.

Second Embodiment

Of the primarily pressure reducing step and the secondarily pressure reducing step, in the secondarily pressure reducing step, where there is a concern for the liquid being injected through the injection needle 5, in some cases, it is desirable that pressure reduction be carried out as slow as possible. If the pressure is rapidly reduced, air generates also in the liquid to easily raise the liquid level. Meanwhile, in view of efficient mass production at the time of manufacturing, it is desirable that an individual step be performed in a short period of time as much as possible. From this point of view, in the present embodiment, the speed of the pressure reduction is adjusted such that the sucking in the secondarily pressure reducing step is performed more slowly than in the primarily pressure reducing step. Specifically, in the secondarily pressure reducing step, gradual pressure reduction is realized by intermittently repeating opening and closing of valves.

Specifically, first, a time period of 50 to 100 ms for the valve 4*a* being opened (pressure reducing time) and a time period of 500 to 1000 ms for the valve 4*a* being closed (waiting time) are each secured, and then pressure reduction and waiting are alternately repeated about five to ten times to realize a more gradual pressure reducing effect than that in the primarily pressure reducing step.

Figure 7C:
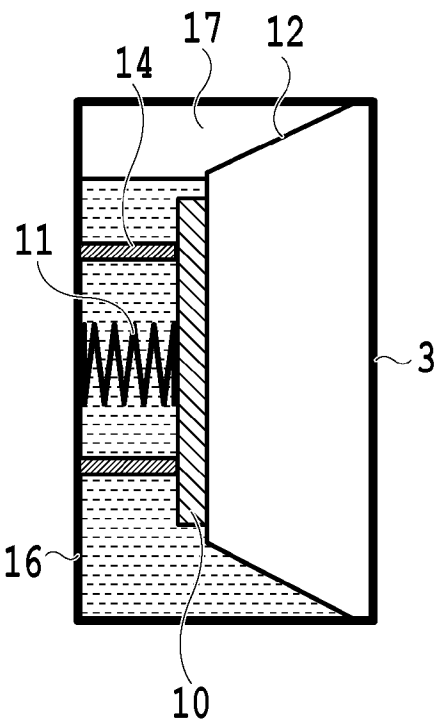
FIGS. 7A to 7C are views showing air trapped within a liquid containing chamber.
Figure 7B:
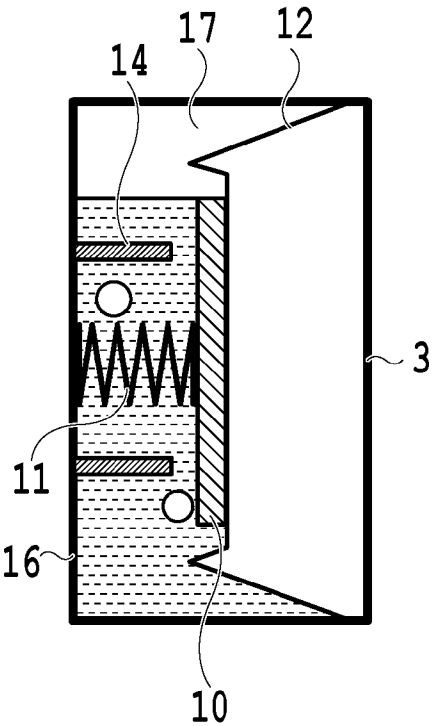
Figure 7A:
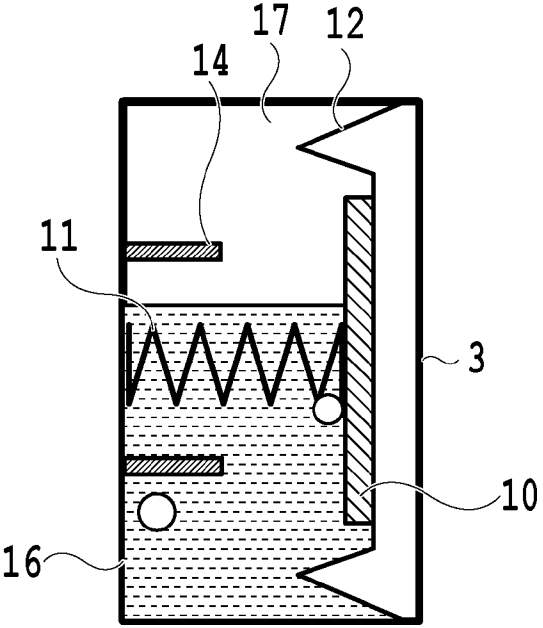

In this case, preparing a plurality of combinations of pressure reducing time, waiting time, and the times of the repetitions to carry them out in turn is also effective. For example, at the stage where the pressure plate 10 moves, thereby changing the capacity of the liquid containing chamber 17, the pressure reducing time is set to be short (50 ms) and the waiting time is set to be long (1000 ms). Thus, as shown in FIGS. 7A to 7C, the air trapped in various portions within the liquid containing chamber 17 is released to promote the collection of the air in the air sump above during the waiting time. Meanwhile, in the latter stage where the capacity is fixed and the state is stabilized, the pressure reducing time is set to be long (100 ms) and the waiting time is set to be short (500 ms). Since the pressure reduction can be performed without a concern that the liquid is sucked in an unstable state, the settings are more freely performed.

According to the liquid filling method of the present embodiment, as stated above, performing the sucking in the secondarily pressure reducing step more slowly than in the primarily pressure reducing step further suppresses the air generation during the sucking, thereby enabling the liquid container to be filled with the liquid with the air remaining in a predetermined amount.

Incidentally, in the above description, immediately after the completion of the primarily injecting step, the secondarily pressure reducing step is performed. However, it is possible to provide, between the primarily injecting step and the secondarily pressure reducing step, a step of bringing the inside of the liquid containing chamber 17 into communication with the atmosphere. Providing this step further enlarges, due to the atmospheric pressure, the capacity of the liquid containing chamber 17 expanded in the primarily injecting step. Thus, it is expected to release the air trapped between the bottom surface of the liquid containing chamber 17 and the flexible sheet 12.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-119645, filed Jun. 10, 2014 which is hereby incorporated by reference wherein in its entirety.

What is claimed is:

1. A liquid filling method of a liquid container that is equipped with: a case member having a supply port for leading out liquid; a flexible sheet which is adhesively fixed to the case member to form, together with the case member, a liquid containing chamber capable of containing the liquid; and a spring member which biases, via a plate member, the flexible sheet in a direction in which a capacity of the liquid containing chamber is enlarged, the liquid filling method comprising:

a primary pressure reducing step of reducing pressure inside the liquid containing chamber to make the capacity of the liquid containing chamber to be a minimum capacity;

a primary injecting step of injecting the liquid in an amount smaller than the minimum capacity into the liquid containing chamber with the pressure reduced in the primary pressure reducing step;

a secondary pressure reducing step of reducing the pressure inside the liquid containing chamber with the liquid injected in the primary injecting step to make the capacity of the liquid containing chamber to be the minimum capacity, followed by sucking air in the liquid containing chamber with a predetermined amount of air remaining; and a secondary injecting step of injecting the liquid into the liquid containing chamber after the secondary pressure reducing step.

2. The liquid filling method according to claim 1, wherein a speed of sucking the air in the secondary pressure reducing step is lower than a speed of sucking the air in the primary pressure reducing step.

3. The liquid filling method according to claim 2, wherein in the secondary pressure reducing step, by alternately repeating a pressure reducing time required for performing pressure reduction inside the liquid containing chamber and a waiting time required for suspending the pressure reduction, the speed of sucking the air is lower than the speed of sucking the air in the primary pressure reducing step.

4. The liquid filling method according to claim 3, wherein a plurality of combinations of the pressure reducing time and the waiting time are carried out in turn, each of the combinations having at least either one of the pressure reducing time and the waiting time being differentiated from those in another combination.

5. The liquid filling method according to claim 1, wherein the minimum capacity is a capacity of the liquid containing chamber in a state where the plate member abuts on supporting posts provided in the case member, thereby controlling a movement of the plate member.

6. The liquid filling method according to claim 1, wherein pressure reduction and injection in the primary pressure reducing step, the primary injecting step, the secondary pressure reducing step, and the secondary injecting step are carried out via the supply port.

7. The liquid filling method according to claim 6, wherein the primary injecting step, the secondary pressure reducing step, and the secondary injecting step are carried out in a posture in which the supply port is positioned above relative to a gravity direction.

8. The liquid filling method according to claim 1, wherein an amount of the liquid injected in the secondary injecting step is an amount obtained by subtracting, from a target amount of the liquid for filling the liquid containing chamber, the amount of the liquid already injected in the primary injecting step.

* * * * *